US009803607B2

(12) United States Patent
Fujita et al.

(10) Patent No.: US 9,803,607 B2
(45) Date of Patent: Oct. 31, 2017

(54) ELECTROMAGNETIC SWITCH DEVICE FOR STARTER

(71) Applicant: DENSO CORPORATION, Kariya, Aichi-pref. (JP)

(72) Inventors: Tatsuya Fujita, Obu (JP); Yoshinori Yamaguchi, Kariya (JP)

(73) Assignee: DENSO CORPORATION, Kariya (JP)

( * ) Notice: Subject to any disclaimer, the term of this patent is extended or adjusted under 35 U.S.C. 154(b) by 366 days.

(21) Appl. No.: 14/610,424

(22) Filed: Jan. 30, 2015

(65) Prior Publication Data

US 2015/0219059 A1 Aug. 6, 2015

(30) Foreign Application Priority Data

Feb. 4, 2014 (JP) ..... 2014-019458

(51) Int. Cl.
*F02N 11/08* (2006.01)
*F02N 15/02* (2006.01)
*F02N 15/06* (2006.01)

(52) U.S. Cl.
CPC ..... *F02N 11/0855* (2013.01); *F02N 11/0851* (2013.01); *F02N 11/087* (2013.01); *F02N 11/0818* (2013.01); *F02N 11/0825* (2013.01); *F02N 15/02* (2013.01); *F02N 15/063* (2013.01); *F02N 15/067* (2013.01); *F02N 2015/061* (2013.01); *F02N 2300/2011* (2013.01)

(58) Field of Classification Search
CPC ..... F02N 11/0855
See application file for complete search history.

(56) References Cited

U.S. PATENT DOCUMENTS

2010/0251852 A1* 10/2010 Murata ..... F02N 11/0844 74/7 A
2012/0312123 A1* 12/2012 Niimi ..... F02N 11/0855 74/7 E
2013/0081514 A1* 4/2013 Abe ..... F02N 11/0855 74/7 C
2014/0102395 A1* 4/2014 Fujita ..... F02N 11/0844 123/179.4

FOREIGN PATENT DOCUMENTS

JP 2012-041859 A 3/2012
JP 2013-002381 A 1/2013

* cited by examiner

*Primary Examiner* — Terence Boes
(74) *Attorney, Agent, or Firm* — Oliff PLC

(57) ABSTRACT

An electromagnetic switch device for a starter includes a pinion-pushing solenoid for pushing out a pinion toward a ring gear of an engine by a plunger thereof, and a motor-energizing solenoid for energizing the motor. The electromagnetic switch device is configured to detect a magnetic flux change in a magnetic circuit of the motor-energizing solenoid due to displacement or deformation of a core of the motor-energizing solenoid caused when the plunger of the pinion-pushing solenoid abuts against a stopper, to determine a timing to start current supply to the motor-energizing solenoid.

7 Claims, 7 Drawing Sheets

START
S1
START COMMAND IS PRESENT ?
NO
YES
S2
DRIVING OF SL1
S3
INDUCED VOLTAGE OCCURRED IN SECOND COIL ?
NO
YES
S5
LIMIT TIME TL HAS ELAPSED ?
YES
NO
S4
DRIVING OF SL2
S6
MEASURING OF ΔT
S7
COMPLETE COPBUSTION HAS BEEN ACHIEVED ?
NO
YES
S9
MOTOR ON ALLOWED TIME HAS ELAPSED ?
YES
NO
S8
STOPPING OF STARTER
S10
ΔT IS SMALLER THAN PREDETERMINED TIME ?
NO
YES
S11
INHIBITION OF IDLE STOP
END

ELECTROMAGNETIC SWITCH DEVICE FOR STARTER

This application claims priority to Japanese Patent Application No. 2014-19458 filed on Feb. 4, 2014, the entire contents of which are hereby incorporated by reference.

BACKGROUND OF THE INVENTION

1. Field of the Invention

The present invention relates to an electromagnetic switch device for a starter, which includes a pinion-pushing solenoid for pushing out a pinion of the starter toward a ring gear and a motor-energizing solenoid for switching on and off a current supplied to a motor.

2. Description of Related Art

There is known a tandem solenoid-type electromagnetic switch device for a starter, which includes two solenoids. One of the two solenoids is a pinion-pushing solenoid for pushing out a pinion of the starter toward a ring gear of an engine, and the other is a motor-energizing solenoid for opening and closing a main contact provided in a current supply circuit of the motor. The tandem solenoid-type electromagnetic switch device is capable of controlling timing to push out the pinion and timing to start the motor independently.

In one known method, the motor-energizing solenoid is driven a predetermined time ΔTx after the pinion-pushing solenoid starts to be driven in response to a command to drive the motor after the pinion abuts against the ring gear. The time ΔTx is ideally a design value of the time elapsed from when the pinion-pushing solenoid starts to be driven to when the pinion abuts against the ring gear. This time is referred to as the "abutment time" hereinafter. However, the abutment time may deviate from the design value depending on the state of a battery, the ambient temperature, variation of the distance between the pinion and the ring gear due to the mounting tolerance on the engine. Accordingly, since the time ΔTx has to be set longer than the design value, the responsiveness is degraded.

In addition, when the time to start during the motor-energizing solenoid is set to the time ΔTx, if the actual abutment time becomes longer than the time ΔTx, there is a possibility that there occurs an engagement failure because the motor starts rotate before the pinion abuts against the ring gear.

Accordingly, it is desired to precisely detect the actual timing at which the pinion and the ring gear abut against each other. Japanese Patent Application Laid-open No. 2012-41859 describes a technique of predicting the timing at which a pinion and a ring gear abut against each other based on inverse rotation engagement. However, this technique cannot be used if the inverse rotation amount of the engine is not sufficiently large.

Japanese Patent Application Laid-open No. 2013-2381 describes a technique applicable to an electromagnetic switch device having the structure in which, between a first coil of a pinion-pushing solenoid and a second coil of a motor-energizing solenoid, a core which is shared by their magnetic circuits is disposed, the technique being for measuring a voltage induced in the coil of the motor-energizing solenoid when the pinion-pushing solenoid abuts against this core. However, this technique cannot be used other than for the structure in which the pinion-pushing solenoid and the motor-energizing solenoid share a core disposed between the first and second coils as part of their magnetic circuits.

SUMMARY

An exemplary embodiment provides an electromagnetic switch device for a starter configured to start an engine by transmitting torque of a motor thereof to a pinion thereof which is engageable with a ring gear of the engine, including:

a pinion-pushing solenoid for pushing out the pinion toward the ring gear, the pinion-pushing solenoid including a first plunger provided with a first coil, the first plunger being configured to be moved within the first coil to an axial end side of the electromagnetic switch device by magnetic force which the first coil generates when being supplied with current, and a first core disposed opposite to the first plunger at the axial end side, the first core forming part of a magnetic circuit of the pinion-pushing solenoid; and a motor-energizing solenoid for energizing the motor, the motor-energizing solenoid including a second coil that generates magnetic force to close a main contact of a power supply circuit of the motor when supplied with current;

the electromagnetic switch device operating such that the second coil starts to be supplied with current after the first coil starts to be supplied with current, wherein the electromagnetic switch device further comprises:

a stopper that restricts movement to the axial end side of the first plunger to define a maximum movement distance to the axial end side of the first plunger;

a second core that forms part of a magnetic circuit of the motor-energizing solenoid, and is disposed so as to be displaced or deformed by an impact pressure caused when the first plunger abuts against the stopper;

a detection section that detects a magnetic flux change in the magnetic circuit of the motor-energizing solenoid due to displacement or deformation of the second core; and a current supply-timing determination section that determines timing to start current supply to the second coil based on a result of detection by the detection section.

According to the exemplary embodiment, there is provided an electromagnetic switch device for a starter, which is capable of correctly detecting a timing when its pinion thereof abuts against a ring gear of an engine in a generic manner.

Other advantages and features of the invention will become apparent from the following description including the drawings and claims.

PREFERRED EMBODIMENTS OF THE INVENTION

Figure 1:
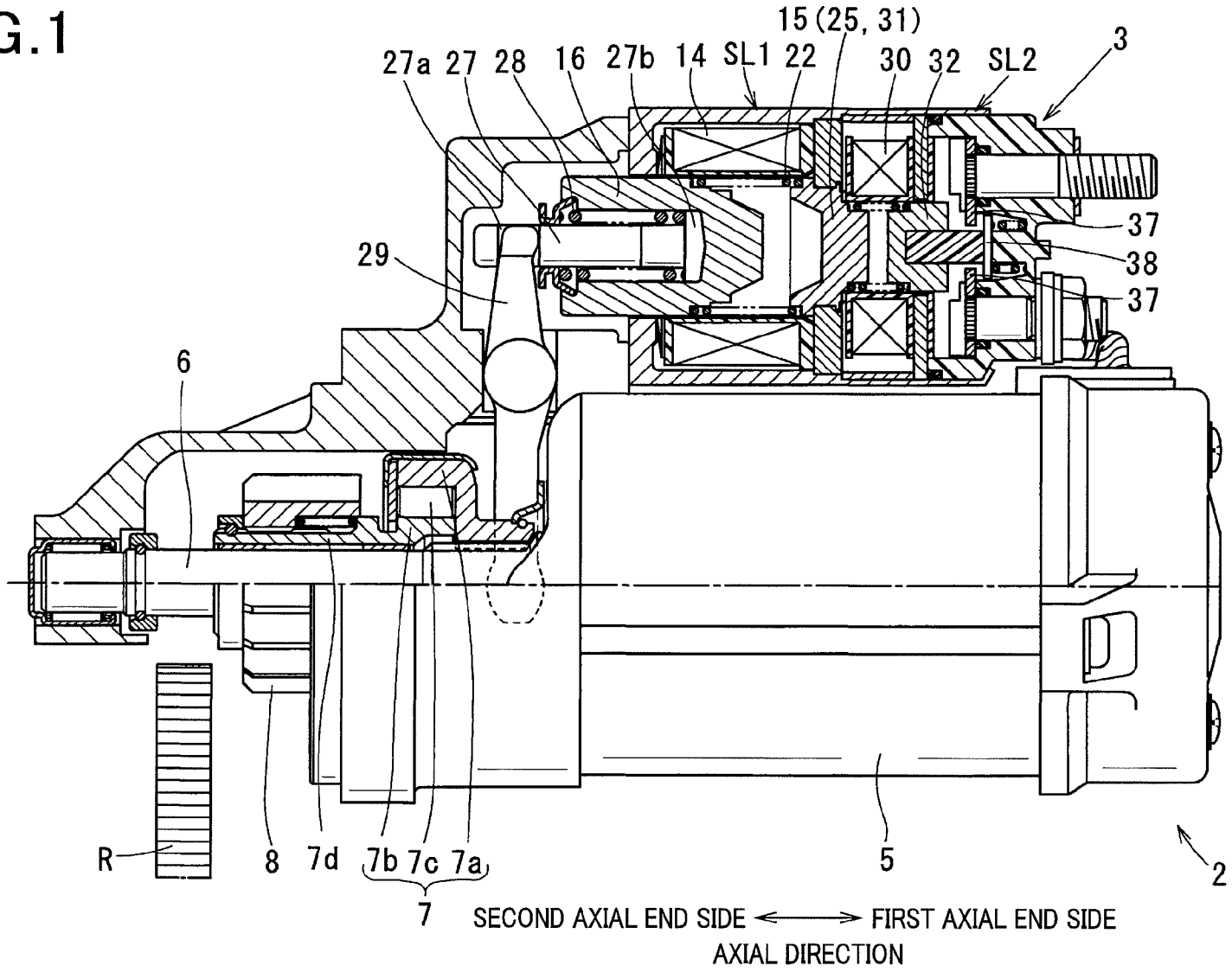
FIG. 1 is a diagram showing an overall structure of a starter including an electromagnetic switch device according to an embodiment of the invention.
Figure 2:
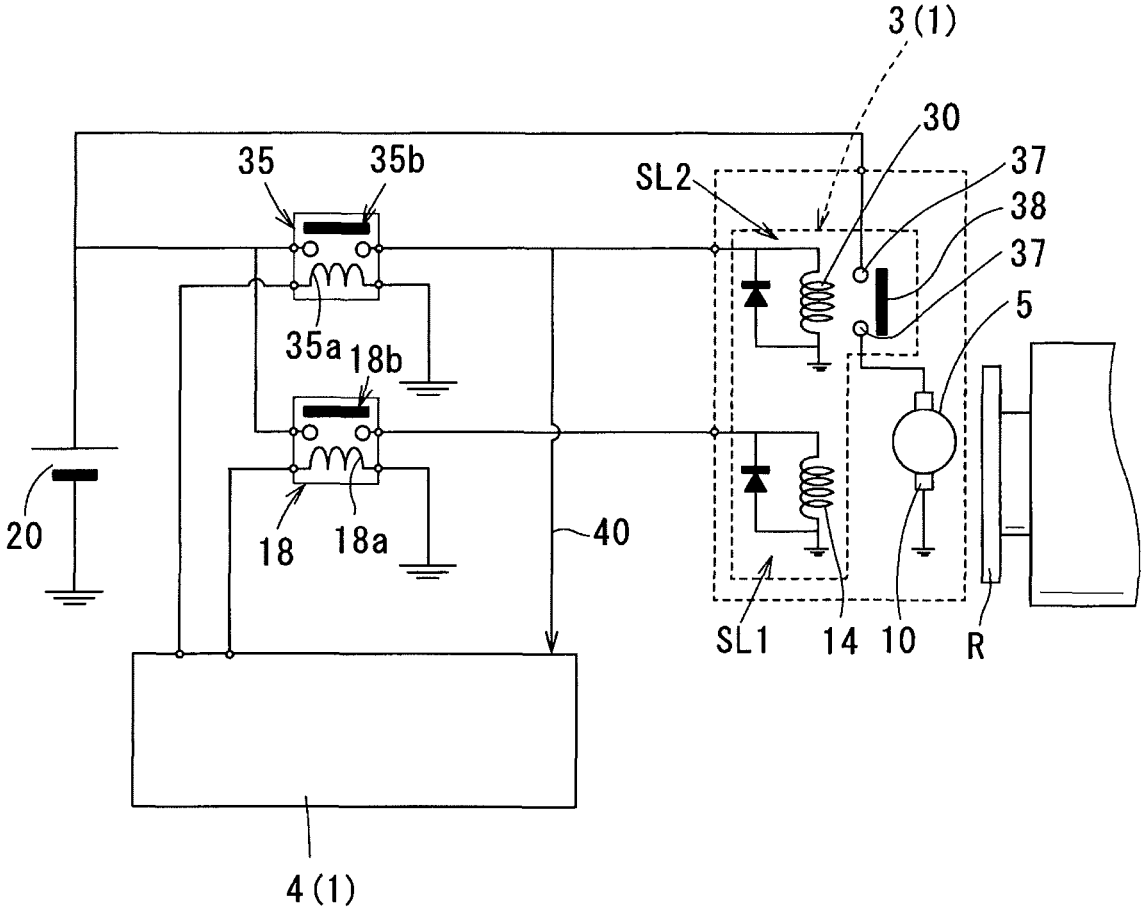
FIG. 2 is an electric circuit diagram of the starter.

FIG. 1 is a diagram showing an overall structure of a starter 2 including an electromagnetic switch device 1 according to an embodiment of the invention. FIG. 2 is an electric circuit diagram of the starter 2. As shown in FIGS. 1 and 2, the electromagnetic switch device 1 includes an electromagnetic switch 3 incorporated in the starter 2, an ECU 4 that controls current supply to the electromagnetic switch 3. In this embodiment, the starter 2 is for use in an idle stop apparatus for controlling automatic stop and restart of an engine.

The starter 2 includes a motor 5, a reduction gear (not shown), an output shaft 6 receiving torque generated by the motor 5 through the reduction gear, a one-way clutch 7 mounted on the output shaft 6, a pinion 8 mounted on the output shaft 6, and the electromagnetic switch 3.

As shown in FIG. 2, the motor 5 is a commutator motor including a field device constituted of permanent magnets, an armature provided with a commutator and disposed at one axial end of its shaft and brushes 10 disposed in contact with the outer periphery of the commutator. The field device of the motor 5 may be constituted of electromagnets instead of the permanent magnets. The output shaft 6 is disposed coaxially with the armature shaft so that the rotation of the armature is reduced by the reduction gear and transmitted to the output shaft 6.

The torque of the motor 5 increased by the reduction gear is transmitted to the pinion 8 through the one-way clutch 7. As shown in FIG. 1, the one-way clutch 7 includes an outer 7*a* helical spline-fitted to the outer periphery of the output shaft 6, an inner 7*b* disposed so as to be rotatable relative to the inner periphery of the outer 7*a*, rollers 7*c* for transmitting and blocking torque between the outer 7*a* and the inner 7*b*, and springs (not shown) for biasing the rollers 7*c*. The one-way clutch 7 transmits the torque only in the direction from the outer 7*a* to the inner 7*b*. The inner 7*b* includes a tube part 7*d* projecting more to the opposite motor side than its part in which the rollers 7*c* are disposed does.

The pinion 8 is a rotating body having gear teeth which mesh with a ring gear R. The pinion 8 is rotatably supported on the outer periphery of a tube part 7*d* together with the tube part 7*d*. The pinion 8 may be formed integrally with the tube part 7*d*.

The electromagnetic switch 3 includes a pinion-pushing solenoid (referred to as the solenoid SL1 hereinafter) for axially pushing out the pinion 8, and a motor-energizing solenoid (referred to as the solenoid SL2 hereinafter) for switching on and off current supply to the motor 5.

Next, the structure of the solenoid SL1 is explained. The solenoid SL1 includes a first coil 14, a first core 15 which is magnetized when the first coil is energized, and a first plunger 16 which is attracted by the magnetized first core 15 to move in the axial direction within the first coil 14.

As shown in FIG. 2, the first coil 14 is grounded at one end thereof, and connected to a drive relay 18 at the other end thereof. The drive relay 18 includes a relay coil 18*a* which is energized by an ON signal outputted from the ECU 4. When the relay coil 18*a* is energized to close a relay contact 18*b*, the first coil 14 is energized by being supplied with current from the battery 20 through the drive relay 18.

The first core 15 is a plate disposed at the right end side in FIG. 1 (referred to as the "first axial end side" hereinafter) of the first coil 14. The end surface at the left end side in FIG. 1 (referred to as the "second axial end side") of the first core 15 faces the axial end surface at the first axial end side of the first plunger 16.

The first plunger 16 moves to the first axial end side when the first coil is 14 is energized. The first plunger 16 is attracted to the first core 15 against the reaction force of a return spring 22 disposed between the first plunger 16 and the first core 15 when the first coil 14 is supplied with current to magnetize the first core 15. When current supply to the first coil 14 is stopped, the first plunger 16 is pushed back to the second axial end side by the reaction force of the return spring 22.

The movement distance of the first plunger 16 becomes maximum when the first plunger 16 is attracted to the first core 15. That is, the first core 15 serves as a stopper 25 for restricting the movement of the first plunger 16 to the first axial end side. As explained later, the starter 2 is configured such that the axial end surface of the pinion 8 abuts against the axial end surface of the ring gear R at the moment when the movement distance of the first plunger 16 becomes maximum, that is, at the timing when the first plunger 16 abuts against the stopper 25. The first plunger 16 moves with a large acceleration and abuts vigorously against the stopper 25.

The first plunger 16 has a cylindrical shape having a cylindrical hole formed in a radially center part thereof. A joint 27 and a drive spring 28 are inserted into the cylindrical hole.

The joint 27, which is a rod-like member for transmitting the motion of the first plunger 16 to a shift lever 29, includes an engagement groove 27*a* formed at one end thereof protruding from the cylindrical hole of the first plunger 16 for engagement with one end of the shift lever 29, and a flange part 27*b* formed at the other end thereof. The flange part 27*b* has an outer diameter slidable on the inner periphery of the cylindrical hole, and is pressed against the bottom of the cylindrical hole by the load of the drive spring 28.

The shift lever 29 is connected to the joint 27 at one end thereof, and connected to the one-way clutch 7 at the other end thereof so as to be swingable around a predetermined fulcrum point. Accordingly, the movement of the first plunger 16 is transmitted to the one-way clutch 7 through the shift lever 29, causing the pinion 8 to move on the output shaft 6 together with the one-way clutch 7.

Next, the structure of the solenoid SL2 is explained. The solenoid SL2 is disposed at the first axial end side in tandem with the solenoid SL1. The solenoid SL2 includes a second coil 30 disposed at the first axial end side of the first coil 14, a second core 31 magnetized when the second coil 30 is supplied with current, and a second plunger 32 attracted by the magnetized second core 31 to move in the axial direction. The solenoid SL2 opens and closes a main contact (to be explained later) of a current supply circuit for supplying current from the battery 20 to the motor 5 in interlock with the movement of the second plunger 32.

As shown in FIG. 2, the second coil 30 is grounded at one end thereof, and connected to a drive relay 35 at the other end thereof. The drive relay 35 includes a relay contact 35*b* and a relay coil 35*a* energized by an ON signal outputted from the ECU 4. When the relay coil 35*a* is energized, the relay contact 35*b* is closed causing the second coil 30 to be supplied with current from the battery 20 through the drive relay 35.

The second core 31 is configured to be displaced or deformed by an impact pressure at the moment when the first plunger 16 abuts against the stopper 25. In this embodiment, the first core 15 doubling as the stopper 25 also doubles as the second core 31.

That is, the first core 15 is a plate disposed between the first coil 14 and the second coil 30 so as to constitute part of a magnetic circuit of the solenoid SL2. Accordingly, the plate constituting the first core 15 serves also as the second core 31, that is, serves also as a member of the magnetic circuit common to the solenoid SL1 and the solenoid SL2. In this configuration, the plate doubling as both the first core 15 and the second core 31 is displaced or deformed by an impact pressure at the moment when the first plunger 16 abuts against the first core 15 serving as the stopper 25. In other words, the second core 31 is displaced or deformed.

However, the structure of the solenoid SL2 is not limited to the one described above. For example, the structure may be such that the second core 31 and the stopper 25 are different members, and the second core 31 is in direct abutment with the stopper 25, or in abutment with the stopper 25 through an additional member so that the second core 31 is displaced or deformed by an impact pressure at the moment when the first plunger 16 abuts against the stopper 25.

That is, the first core 15 (stopper 25) may not double as the second core 31, if an impact pressure at the moment when the first plunger 16 abuts against the stopper 25 is transmitted to the second core 31. For example, the solenoid SL2 may be configured such that the first core 15 and the second core 31 are different members, a non-magnetic plate is interposed between the first core 15 and the second core 31, and an impact pressure at the moment when the first plunger 16 abuts against the stopper 25 is transmitted to the second core 31 causing the second core 31 to be displaced or deformed.

The main contact is constituted of a pair of fixed contacts 37 and a movable contact 38. The main contact is closed when the fixed contacts are made conductive therebetween through the movable contact 38 moved in interlock with the movement of the second plunger 32, and is opened when the movable contact 38 separates from the fixed contacts 37 to interrupt conduction therebetween.

When the second coil 30 is not supplied with current, the main contact is in the open state, and the motor is not supplied with current. When the second coil 30 starts to be supplied with current (solenoid SL2: ON), the second plunger 32 moves to close the main contact causing the motor 5 to be supplied with current.

The ECU 4 controls current supply to the first coil 14 and the second coil 30 by controlling current supply to the drive relays 18 and 35. More specifically, the ECU 4 performs control such that the second coil 30 starts to be supplied with current at a predetermined timing after the first coil 14 starts to be supplied with current. The timing to start current supply to the second coil 30 is explained in detail later.

Figure 3:
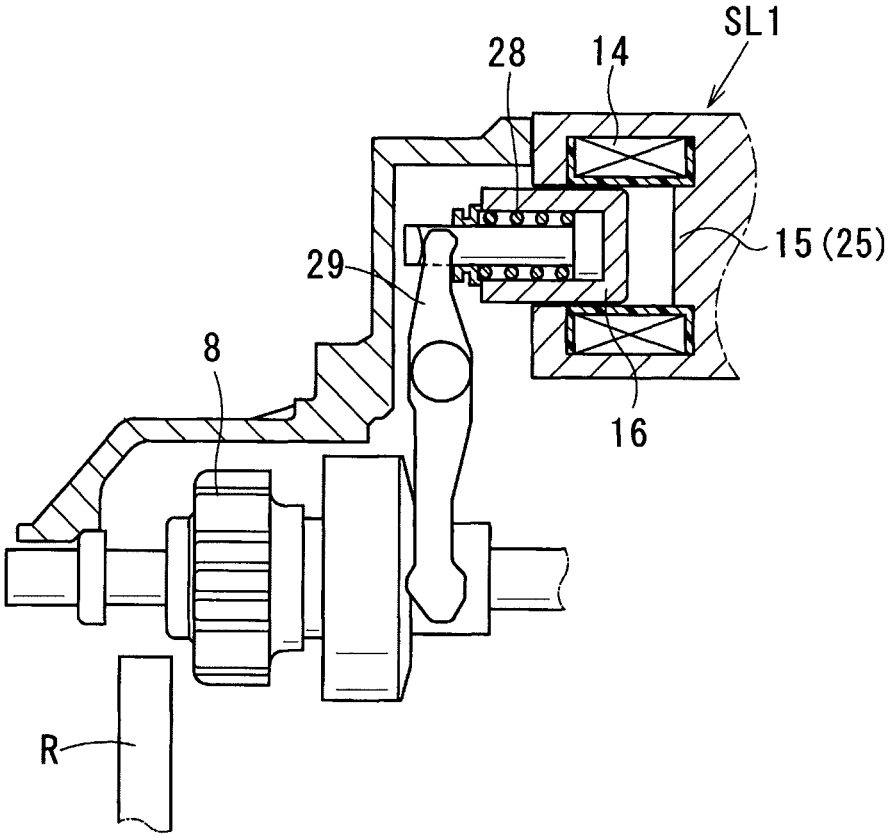
FIG. 3 is a partial cross-sectional view of the starter.
Figure 4:
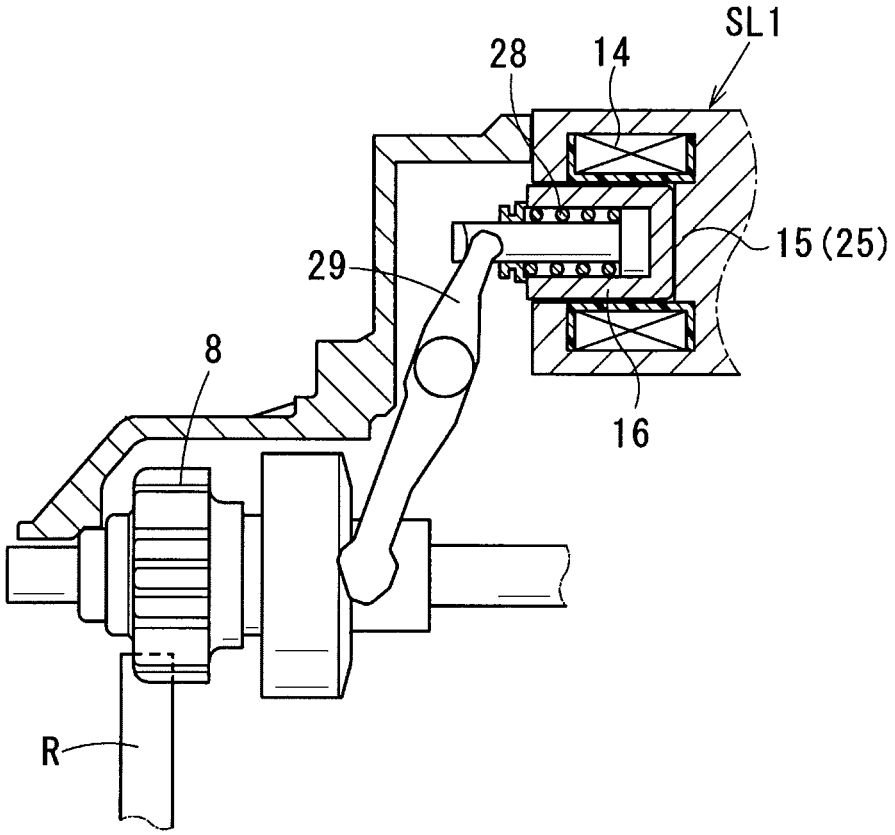
FIG. 4 is a partial cross-sectional view of the starter.
Figure 5:
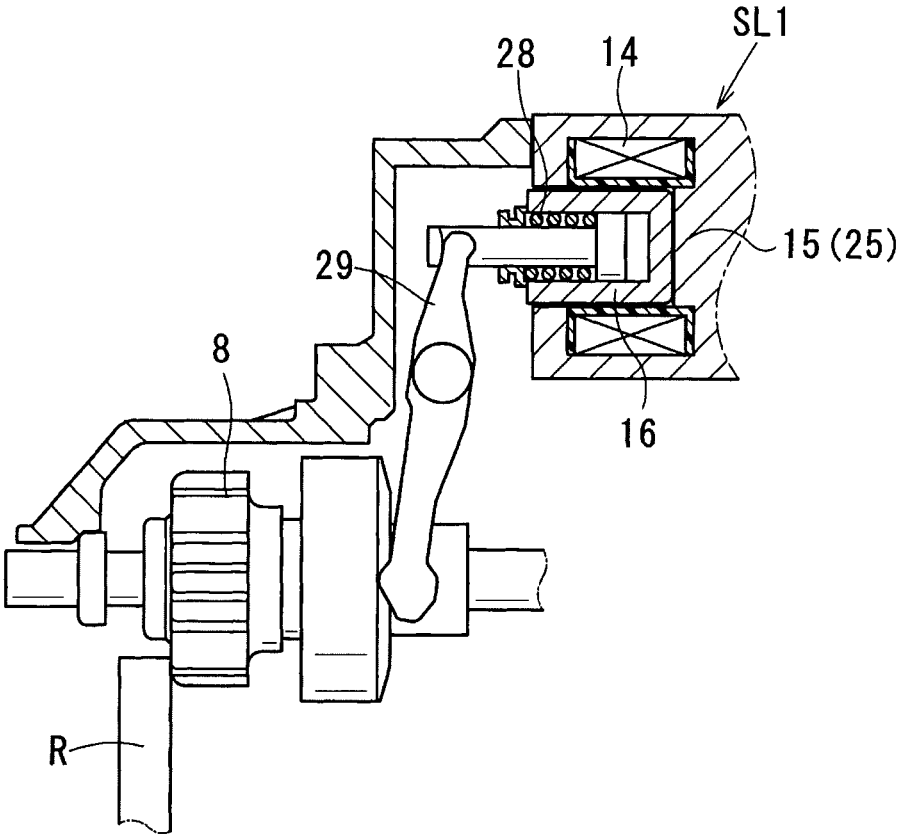
FIG. 5 is a partial cross-sectional view of the starter.

Next, the operation of the solenoid SL1 is explained with reference to FIGS. 3 to 5. When the first coil 14 in the non-energized state shown in FIG. 3 is supplied with current, the first plunger 16 moves by the maximum movement distance to abut against the stopper 25. In interlock with the movement of the first plunger 16, the pinion 8 is pushed out toward the ring gear R. At this time, if the relative rotational position between the pinion 8 and the ring gear R is at a position where they can mesh with each other, the pinion 8 and the ring gear 8 mesh with each other (see FIG. 4) at approximately the same moment when the first plunger 16 abuts against the stopper 25.

On the other hand, if the relative rotational position between the pinion 8 and the ring gear R is at a position other than the position where they can mesh with each other, the end surface of pinion 8 abuts against the end surface of the ring gear R (see FIG. 5) at approximately the same moment when the first plunger 16 abuts against the stopper 25. At this time, the drive spring 28 stores a reaction force by being compressed. Thereafter, when the relative rotational position between the pinion 8 and the ring gear R comes to the position where they can mesh with each other, the pinion 8 meshes with the ring gear R by the reaction force stored in the drive spring 28 (see FIG. 4).

That is, the timing when the first plunger 16 abuts against the stopper 25 is the timing when the pinion 8 meshes with the ring gear R or the timing when the axial end surface of the first plunger 16 abuts against the axial end surface of the ring gear R. Accordingly, the starter 2 can be driven smoothly without causing engagement failure between the pinion 8 and the ring gear R by causing the motor 5 to rotate after this timing.

Figure 6:
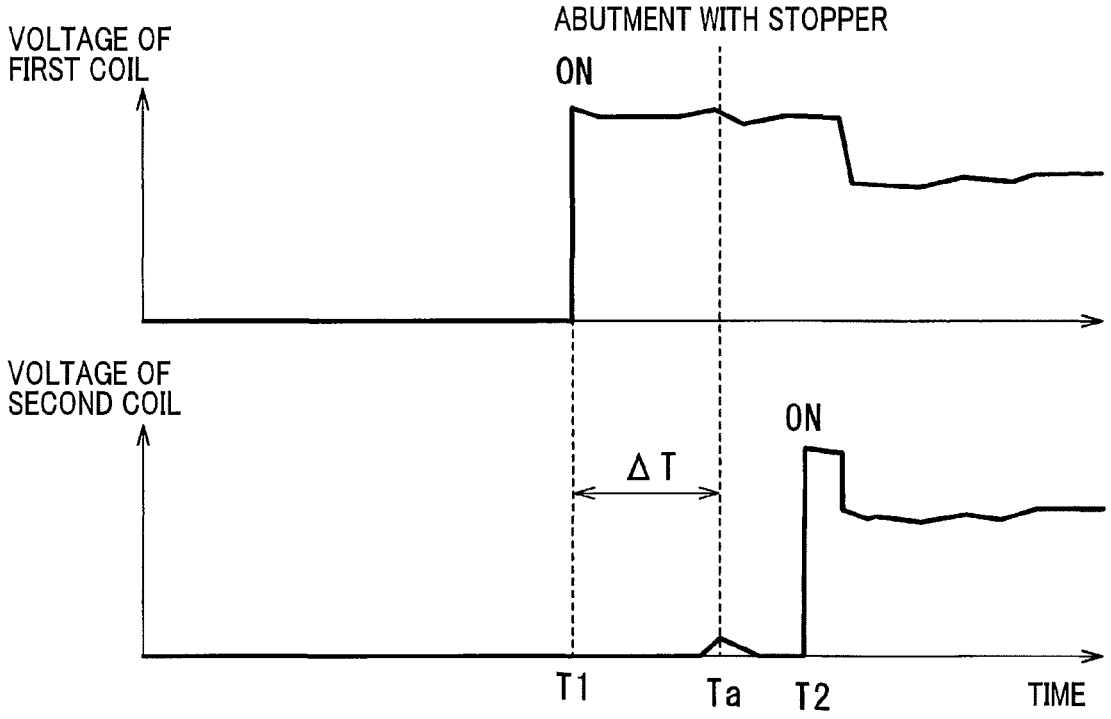
FIG. 6 is a timing chart of voltages of a pinion-pushing solenoid and a motor-energizing solenoid of the electromagnetic switch device.

Next, the structure to detect the timing when the first plunger 16 abuts against the stopper 25 is explained. The electromagnetic switch device 1 includes a detection section for detecting a magnetic flux change in the magnetic circuit of the solenoid SL2 due to displacement or deformation of the second core 31. When a magnetic flux change occurs in the magnetic circuit of the solenoid SL2 due to displacement or deformation of the second core 31, an induced voltage (or an induced current) occurs in the second coil 30. That is, as shown in FIG. 6, an induced voltage occurs in the second coil 30 at the timing Ta when the first plunger 16 abuts against the stopper 25. In this embodiment, the detection section detects such a magnetic flux change by detecting this induced voltage.

More specifically, the detection section samples the voltage of a current supply circuit of the second coil 30 through a signal line 40 (see FIG. 2) at a predetermined sampling period, and determines that a magnetic flux change has occurred when a sampled voltage exceeds a predetermined value. In this embodiment, the ECU 4 serves as the detection unit.

Next, a method of determining the timing to start current supply to the second coil 30 is explained. The electromagnetic switch device 1 includes a current supply-timing determination section for determining the timing to start current supply to the second coil 30 based on the detection result of the detection section. In this embodiment, the ECU 4 serves as the current supply-timing determination section.

The current supply-timing determination section determines a predetermined timing T2 later than the timing Ta when a magnetic flux change is detected by the detection section as the timing to start current supply to the second coil 30 (see FIG. 6).

In this embodiment, a time a predetermined time after time T1 at which current supply to the first coil 14 is started is set as a limit time TL, and if the limit time TL has elapsed before a magnetic flux change is detected, the current supply-timing determination section determines a certain time after the time TL as the timing when current supply to the second coil 30 should be started.

The ECU 4 also serves as an elapsed time measuring section for measuring the time ΔT elapsed from when current supply to the first coil 14 is started to when a magnetic flux change is detected. If the measured time ΔT exceeds a predetermined value, the ECU 4 reduces the frequency of performing idle stop, or inhibits performing idle stop. The limit time TL to be used for the next time operation of the starter 2 may be adjusted in accordance with the time ΔT measured in the present time operation.

Figure 7:
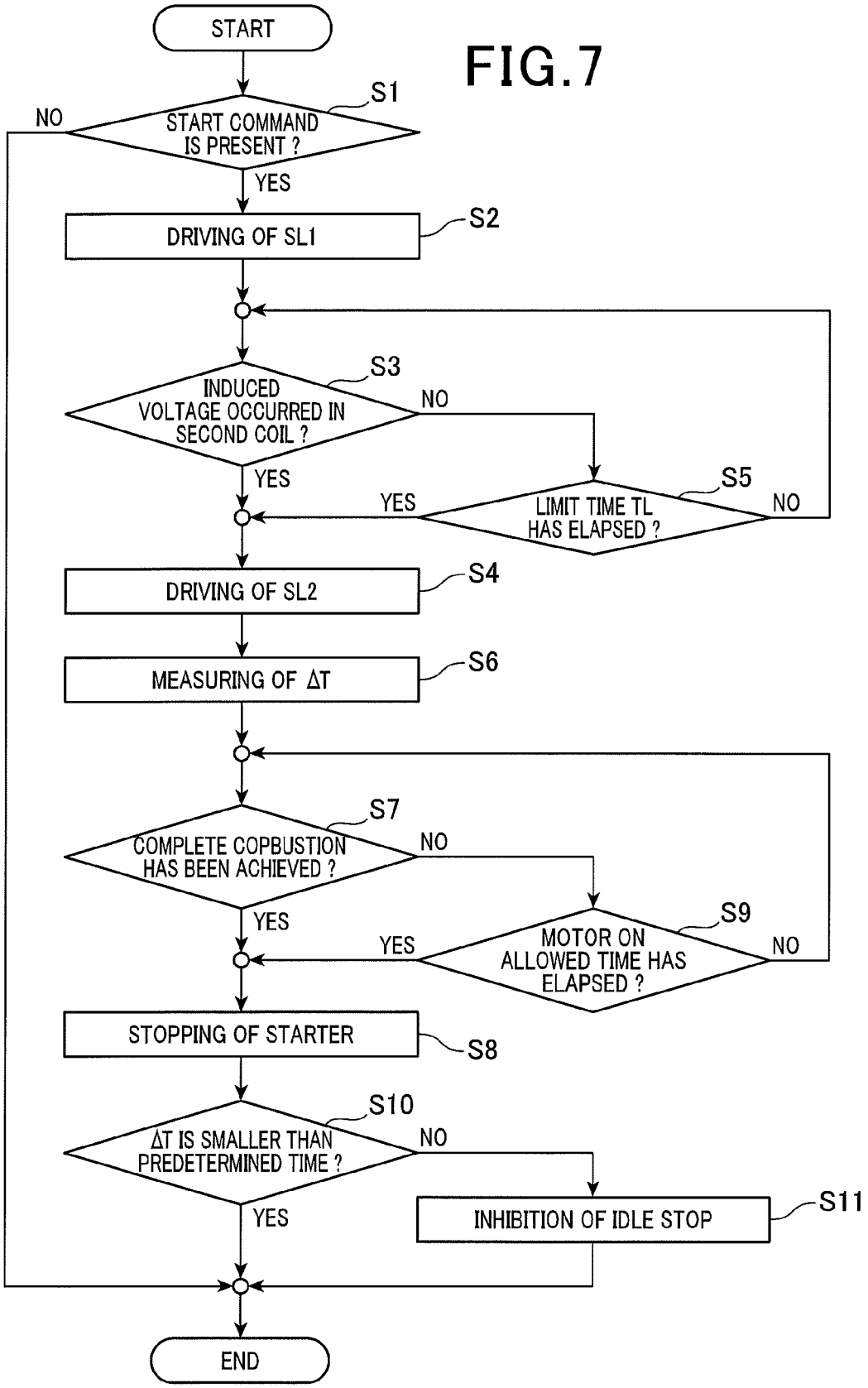
FIG. 7 is a flowchart showing steps of a control flow of the starter.

Next, a control flow of the starter 2 is explained with reference to FIGS. 6 and 7. The control flow begins in step S1 where it is detected whether or not a start command is present. If the detection result in step S1 is affirmative, the control flow proceeds to step S2 where current supply to the first coil 14 is started to drive the solenoid SL1.

In subsequent step S3, it is detected whether or not an induced voltage higher than a predetermined value has occurred in the current supply circuit of the second coil 30. That is, it is detected whether or not a magnetic flux change has occurred in the second coil 30 due to abutment of the first plunger 16 against the stopper 25. If the detection result in step S3 is affirmative, the control flow proceeds to step S4 to start current supply to the second coil 30 to thereby drive the solenoid SL2. As a result, current supply to the motor 5 is started. If the detection result in step S3 is negative, the control flow proceeds to step S5 to detect whether or not the limit time TL has elapsed. If the detection result in step S5 is affirmative, the control flow proceeds to step S4 to start current supply to the second coil 30 to thereby drive the solenoid SL2. If the detection result in step S5 is negative, the control flow returns to step S3.

In step S6 following step S4, the time ΔT, that is, the time elapsed from when current supply to the first coil 14 is started to when the magnetic flux change is detected is measured.

In subsequent step S7, it is detected whether or not the engine has achieved complete combustion. If the detection result in step S7 is affirmative, the control flow proceeds to step S8 to stop driving the starter 2 by stopping the motor 5 or returning the pinion 8 to its initial position. If the detection result in step S7 is negative, the control flow proceeds to step S9 where it is detected whether or not a predetermined time (referred to as the "motor ON allowed time" hereinafter) has elapsed from the time when current supply to the second coil 30 was started. If the detection result in step S9 is affirmative, the control flow proceeds to step S8 to stop driving the starter 2, and otherwise returns to step S7.

Thereafter, in step S10 following step S9, it is detected whether or not the time ΔT measured in step S6 is smaller than a predetermined time. If the detection result in step S10 is negative, the control flow proceeds to step S11 to inhibit idle stop assuming that the time necessary for the first plunger 16 to abut against the stopper 25 is prolonged for some reason.

Incidentally, step S6 may be included in a different control flow instead of being included in this control flow. In this case, the above control flow refers to the time ΔT measured in this different control flow.

The embodiment described above provides the following advantages. The timing when the first plunger 16 moves by the maximum movement distance (the timing when the first plunger 16 abuts against the stopper 25) can be detected by detecting a magnetic flux change in the magnetic circuit of the solenoid SL2 caused by the collision between the stopper 25 and the first plunger 16. That is, it is possible to directly confirm that the first plunger 16 has reached the maximum movement distance. Accordingly, even if the time necessary for the first plunger 16 to reach the maximum movement distance from when current supply to the first coil 14 is started varies due to degradation of the battery 20 and so on, it is possible to perform the control such that the solenoid SL2 starts to be driven definitely after the first plunger has reached the maximum movement distance.

Hence, according to the above embodiment in which the pinion 8 and the ring gear R abut against each other or mesh with each other when the first plunger 16 has reached the maximum movement distance, it is possible to correctly detect the timing when they abut against each other or mesh with each other by detecting the timing when the first plunger 16 abuts against the stopper 25. This makes it possible to cause the motor 5 to reliably rotate after the pinion 8 and the ring gear R abut against each other or mesh with each other to avoid insufficient engagement between the pinion 8 and the ring gear R.

The present invention works for the structure where the second core 31 is displaced or deformed by the collision between the stopper 25 and the first plunger 16, regardless whether or not part of the magnetic circuit is shared by the solenoid SL1 and the solenoid SL2. That is, the electromagnetic switch device 1 may be modified such that the first core 15 and the second core 31 are different members, and a magnetic plates is interposed between them.

In the above embodiment, a magnetic flux change in the magnetic circuit of the solenoid SL2 is detected by detecting a voltage or current induced in the second coil 30. Accordingly, it is not necessary for the electromagnetic switch device 1 to include any sensor dedicated to detecting a magnetic flux change.

In the above embodiment, the second coil 30 starts to be supplied with current after an elapse of a predetermined time from start of current supply to the first coil 14 regardless whether or not a magnetic flux change is detected. This can eliminate a problem that the starter cannot be started when a magnetic flux change cannot be detected for some reason.

In the above embodiment, the frequency of performing idle stop is reduced or performing idle stop is inhibited if the time ΔT elapsed from when current supply to the first coil 14 is started to when a magnetic flux change is detected exceeds a predetermined time. This makes it possible to refrain performing idle stop before a fault occurs.

Other Embodiments

In the above embodiment, the solenoid SL1 and the solenoid L2 are disposed axially in tandem. However, they may be disposed side by side. That is, the solenoid SL1 and the solenoid L2 may be arranged in the radial direction. Also in this case, the timing when the first plunger has reached the maximum movement distance can be detected by detecting a magnetic flux change, if the stopper 25 and the second core 31 are in direct abutment or in abutment through an additional member.

In the above embodiment, a magnetic flux change is detected by detecting a current or a voltage induced in the second coil 30. However, it may be detected using a magnetic sensor.

The above explained preferred embodiments are exemplary of the invention of the present application which is described solely by the claims appended below. It should be understood that modifications of the preferred embodiments may be made as would occur to one of skill in the art.

What is claimed is:

1. An electromagnetic switch device for a starter configured to start an engine by transmitting torque of a motor thereof to a pinion thereof which is engageable with a ring gear of the engine, the electromagnetic switch device comprising:

a pinion-pushing solenoid for pushing out the pinion toward the ring gear, the pinion-pushing solenoid including a first plunger provided with a first coil, the first plunger being configured to be moved within the first coil to an axial end side of the electromagnetic switch device by magnetic force which the first coil generates when being supplied with current, and a first core disposed opposite to the first plunger at the axial end side, the first core forming part of a magnetic circuit of the pinion-pushing solenoid;

a motor-energizing solenoid for energizing the motor, the motor-energizing solenoid including a second coil that generates magnetic force to close a main contact of a power supply circuit of the motor when supplied with current, the electromagnetic switch device operating such that the second coil starts to be supplied with current after the first coil starts to be supplied with current;

a stopper that restricts movement to the axial end side of the first plunger to define a maximum movement distance to the axial end side of the first plunger;

a second core that forms part of a magnetic circuit of the motor-energizing solenoid, and is disposed so as to be displaced or deformed by an impact pressure caused when the first plunger abuts against the stopper;

a detection section that detects a magnetic flux change in the magnetic circuit of the motor-energizing solenoid due to displacement or deformation of the second core; and a current supply-timing determination section that determines timing to start current supply to the second coil based on a result of detection by the detection section.

2. The electromagnetic switch device for a starter according to claim 1, wherein the detection section detects the magnetic flux change by detecting a voltage or a current induced in the second coil.

3. The electromagnetic switch device for a starter according to claim 2, wherein the electromagnetic switch device operates such that the second coil starts to be supplied with current after the voltage or current detected by the detection section exceeds a predetermined value.

4. The electromagnetic switch device for a starter according to claim 1, wherein the electromagnetic switch device operates such that, if the detection section does not detect a magnetic flux change within a predetermined time from when the first coil starts to be supplied with current, the second coil starts to be supplied with current after an elapse of the predetermined time.

5. The electromagnetic switch device for a starter according to claim 1, further comprising:

an elapsed time measuring section that measures a time elapsed from when the first coil starts to be supplied with current to when the detection section detects the magnetic flux change, the electromagnetic switch device operating to reduce frequency of performing idle stop to stop the engine when a predetermined engine stop condition is satisfied, or inhibit performing the idle stop if the measured elapsed time exceeds a predetermined value.

6. The electromagnetic switch device for a starter according to claim 1, wherein the first core doubles as the stopper.

7. The electromagnetic switch device for a starter according to claim 1, wherein the first core doubles as the second core.

* * * * *